United States Patent [19]

Hall

[11] Patent Number: 4,620,594

[45] Date of Patent: Nov. 4, 1986

[54] VERTICAL CONFORMANCE STEAM DRIVE OIL RECOVERY METHOD

[75] Inventor: Wilbur L. Hall, Bellaire, Tex.

[73] Assignee: Texaco Inc., White Plains, N.Y.

[21] Appl. No.: 638,925

[22] Filed: Aug. 8, 1984

[51] Int. Cl.[4] ..... E21B 43/24

[52] U.S. Cl. ..... 166/263; 166/272

[58] Field of Search ..... 166/263, 272, 245, 292

[56] References Cited

U.S. PATENT DOCUMENTS

| | | | |
|---|---|---|---|
| 4,166,504 | 9/1979 | Brown et al. | 166/263 |
| 4,175,618 | 11/1979 | Wu et al. | 166/263 |
| 4,431,056 | 2/1984 | Shu | 166/263 |
| 4,444,261 | 4/1984 | Islip | 166/272 |
| 4,470,462 | 9/1984 | Hutchison | 166/292 |

*Primary Examiner*—Stephen J. Novosad
*Assistant Examiner*—Bruce M. Kisliuk
*Attorney, Agent, or Firm*—Robert A. Kulason; James J. O'Loughlin

[57] ABSTRACT

The condition known as steam override is overcome by the use of a blocking agent to obstruct fluid flow in part of the override region combined with the closing of all passages of egress for injected steam except those having access to the region where by-passed oil has been banked.

6 Claims, 4 Drawing Figures

VERTICAL CONFORMANCE STEAM DRIVE OIL RECOVERY METHOD

SUMMARY OF THE INVENTION

My invention concerns an improved method of recovering petroleum, especially viscous petroleum, from a subterranean, petroleum-containing formation, said formation being penetrated by at least two wells, including one injection well and one production well, both of said injection and production wells being in fluid communication with a substantial portion of the formation, said injection and production wells defining a recovery zone within the formation.

More particularly my invention is concerned with an improvement for overcoming the condition which occurs in steam flooding operations, known as "steam-override", or in other words for achieving better vertical conformance. This condition results from the fact that vapor phase steam, being of less specific gravity than petroleum and other fluids present in the pore spaces of the formation, tends to gravitate toward the upper portion of the formation and to sweep out preferentially this upper portion. Once this has occurred, then all the subsequently injected steam tends to follow the same path in the upper portion and to exert little or no sweeping action on the petroleum-saturated lower portions, and the condition is known as steam-override.

It would appear that steam-override might be cured by simply converting the production well to injection and the injection well to production and forcing steam low into the formation around the new injection well in order to sweep out the hot oil banked around the lower portion of the new injection well. However, wells in formations that have reached this condition of steam-override are normally gravel pack completions across the whole oil column, and steam injected low in the new injection well will quickly sweep oil from the near well bore area and then rise into the established override zone, with the result that the main body of oil banked around the lower portion of the new injection well is still bypassed. Therefore it is necessary not only to force steam low into the formation around the new injection well but also to prevent the injected steam from readily reaching the established override zone.

In one embodiment according to the method of my invention the condition of steam-override is overcome and vertical conformance is improved by the combination of:

1. reversing the functions of the injection and production wells,
2. blocking the override region in the upper portion of the formation around the new injection well so that steam can no longer flow therethrough, and
3. closing all passages of egress for steam injected into the new injection well except those having access to the lower portion of the formation so that steam flowing through those passages sweeps the lower portion of the formation.

Other embodiments involve the above steps of blocking the override region and closing passages of egress for steam but:

(a) with the difference that the functions of the injection and production wells are not reversed but are maintained the same, or (b) an infill well between the injection and production wells is utilized as a production well, or (c) the blocking agent for blocking the override region is used to sweep petroleum towards a production well, or (d) some combination of the above embodiments.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

Figure 1:
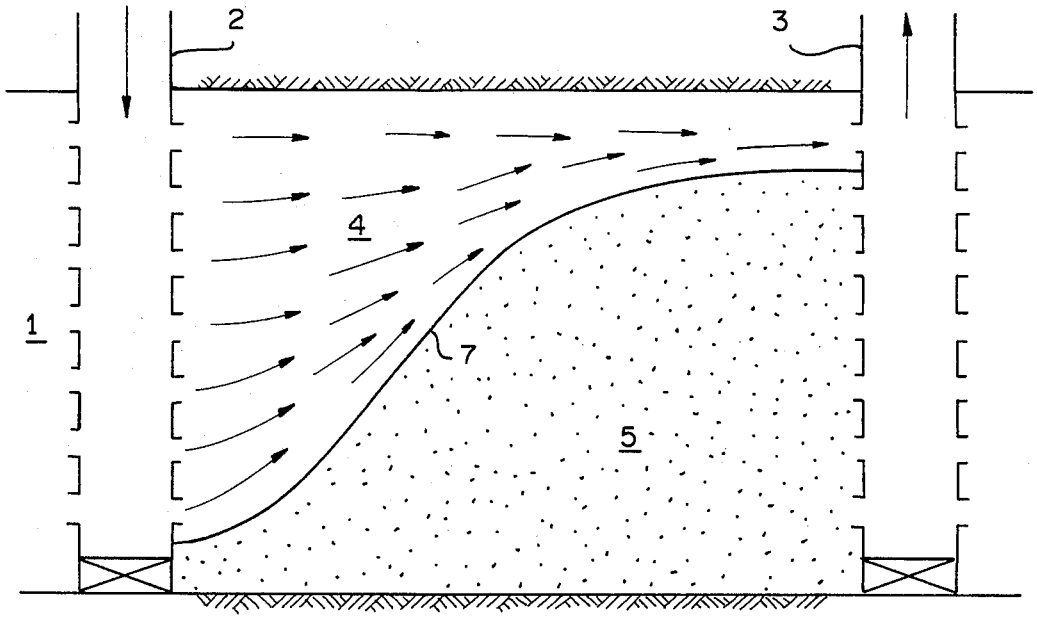
FIG. 1 PRIOR ART
FIG. 1 illustrates a vertical plan view of a subterranean formation penetrated by an injection well and a production well in a state-of-the-art steam drive oil recovery method such as is taught in the prior art, illustrating how the injected steam migrates to the upper portion of the formation as it travels through the recovery zone within the formation between the injection well and production well. The action of steam overriding and bypassing a significant amount of the petroleum saturated portion of the oil recovery zone is shown in this drawing.

The problem of steam override which occurs inherently in prior art steam drive enhanced oil recovery processes, for which the process of our invention is intended as an improvement, is best understood by referring to FIG. 1, which illustrates how a relatively thick, viscous oil-containing formation 1 is penetrated by an injection well 2 and a production well 3 in a conventional steam drive oil recovery process as is taught in the prior art. Each of wells 2 and 3 is lined through formation 1 with a section of well casing known as a liner 10, having perforations as shown in the Figures, through which perforations fluid can flow between the formation and the wells. Steam is injected into the formation via well 2, passing through the perforations in well 2 and out into the viscous oil formation. Conventional practice is to perforate or establish fluid flow communication between well 2 and the formation throughout the full vertical thickness of the formation, both with respect to injection well 2 and production well 3. Notwithstanding the fact that steam is injected into the full vertical thickness of the formation, it can be seen that steam migrates in an upward direction as it moves horizontally through the formation while passing from well 2 toward production well 3. The result of this movement is the creation of a steam swept zone 4 in the upper portion of the formation and zone 5 in the lower portion of the formation through which little or no steam has passed. Since little or no steam has passed through zone 5, very little oil has been recovered from zone 5. Once steam breakthrough at production well 3 occurs, continued injection of steam into the formation via well 2 will not cause any significant amount of steam to flow into section 5 for the following two reasons.

(1) The specific gravity of vapor phase steam is significantly less than the specific gravity of petroleum and other liquids present in the pore spaces of the formation; therefore, gravitational forces will cause steam vapors to be confined largely to the upper portion of the formation. This phenomenon is referred to in the art as steam override.

(2) Steam passing through the upper portion of the formation displaces and removes petroleum from the pore spaces of that portion of the formation, thus desaturating the zone and increasing the relative permeability of that portion of the formation significantly as a consequence of removing viscous petroleum therefrom. Thus, any injected fluid will travel even more readily through the desaturated portion 4 of the formation than it will through the portion 5 which is near original viscous petroleum saturation level.

The term "steam injection" as used herein is to be understood as referring to the injection of steam, either alone or in combination with some other substance which improves the effectiveness of steam drive oil displacement. For example, non-condensable gases such as nitrogen or carbon dioxide may be mixed or co-mingled with steam injected into the formation for the purpose of improving oil recovery efficiency. Miscible fluids, such as hydrocarbons in the range of C1 to C10, may be mixed with the steam, usually in the concentration range of from 1–25 and preferably 5–10% by weight. The presence of hydrocarbons co-mingled with steam injected into a viscous oil formation improves the effectiveness of the injected fluid for reducing oil viscosity and therefore improves the oil displacement effectiveness of the process. In yet another embodiment, air and steam are co-mingled in the ratio of from 0.05–2.0 standard cubic feet of air per pound of steam, which accomplishes a low temperature, controlled oxidation reaction within the formation and achieves improved thermal efficiency under certain conditions. So long as a major portion of the fluid injected into injection well 2 comprises vapor phase steam, the problem of steam override and channeling will be experienced in the steam drive oil recovery process no matter what other materials are included in the injected fluid in addition to steam, and the process of our invention may be applied to any steam drive oil recovery process with the resultant improvement of oil recovery.

FIG. 1 shows the condition of steam override which is commonly found after steam has been injected at injection well 2 for a period of time and has broken through at production well 3. Region 4 has been swept by steam so that it is now highly permeable, but region 5 is essentially unaffected and is still petroleum-saturated, since steam rides easily over region 5 through the permeable region 4. The interface between regions 4 and 5 is indicated by 7.

Figure 2:
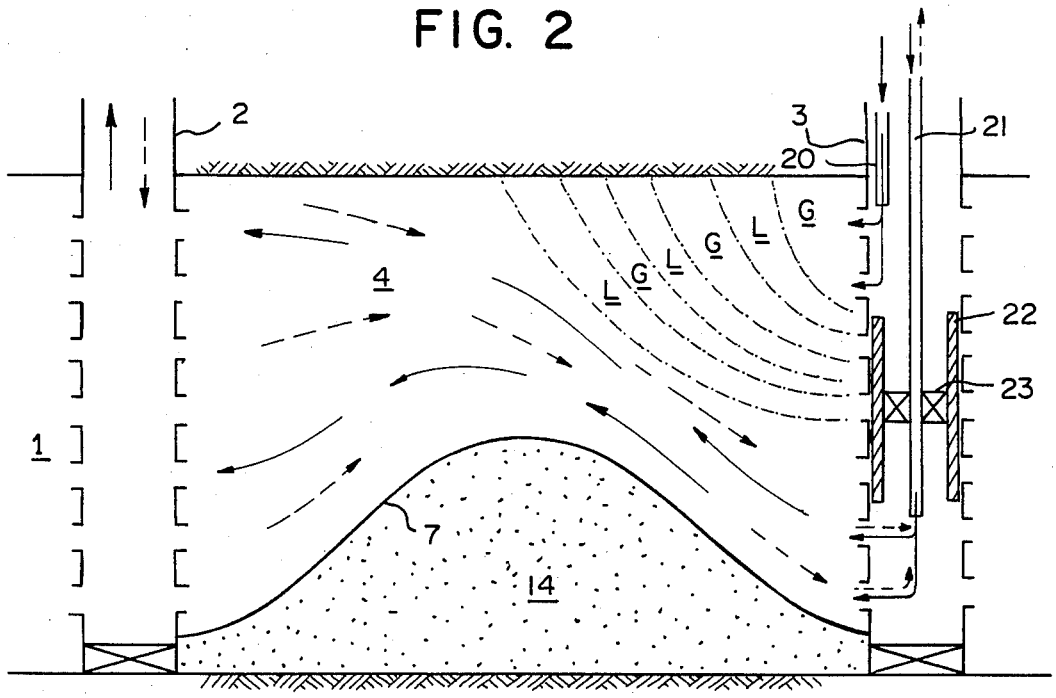
FIG. 2 illustrates the same view of the subterranean formation as FIG. 1 after the steps of this invention have been taken to close off all passages of fluid communication between the production well and the formation except those communicating with a top fraction less than half and a bottom fraction less than half of the formation and to block the override region in the upper portion of the formation around the production well. Two embodiments are illustrated in FIG. 2, one with solid arrows representing reverse steam flooding using the injection and production wells as production and injection wells respectively, and one with dashed arrows representing forward steam flooding using the injection and production wells in their original intended way.

The method of this invention in its simplest form is illustrated by FIG. 2, in which two embodiments are shown, the first as indicated by solid arrows and the second by dashed arrows. For both embodiments a section of non-perforated casing 22 is cemented inside the liner 10 of well 3, bridging over and sealing off the perforations of the middle portion of the liner so that fluid communication between formation 1 and well 3 is limited to the top and bottom perforations of well 3. Packer 23 is then set on tubing 21 inside bridging casing 22, and a second tubing 20 is hung above packer 23, so that a dual completion is achieved, and dual injection can be carried out in well 3. After the dual completion is finished, steps are taken to block off the steam override region radially outwardly from well 3 by use of a blocking agent introduced through tubing 20 into the formation surrounding the upper perforations of well 3. The blocking action which is to be accomplished is three-dimensional, not just at the well liner itself. The object is to obstruct fluid flow *within* the formation surrounding the upper perforations of well 3, not merely the flow *between* the formation and well 3. In other words plugging the perforations only would not accomplish the desired blocking. One way to achieve the desired three-dimensional blocking is by injection through tubing 20 and out through perforations of well 3 of warm production water alternating with flue gas or other suitable gas, so that alternate zones of liquid and gas are formed out in the formation as indicated in FIG. 2 by the alternate L and G zones in region 24. Such alternating liquid and gas injections have a jamming effect on the permeability of the formation so that fluid flow through the region containing the L and G Zones is effectively obstructed. Similar use of alternate liquid and gas injections in known in the art—see for example U.S. Pat. No. 3,244,228.

In the first embodiment (shown by solid arrows in FIG. 2) steam is injected in well 3 through tubing 21, either concurrently with the jamming step or following it, and sweeps outwardly through the lower perforations of well 3 into formation 1. The jammed region prevents the steam from passing therethrough and forces it to pass low through the hitherto unswept portion of the formation as shown by FIG. 2. The hitherto unswept region shown as 5 in FIG. 1 is thereby reduced in size to the region shown as 14 in FIG. 2, and a significant portion of the hot oil that had been banked around the bottom of well 3 is produced from well 2. Thus vertical conformance has been improved.

In the second embodiment, (as shown by the dashed arrows in FIG. 2) instead of injecting steam through tubing 21 in well 3 and producing at well 2 the procedure is to continue injecting steam through well 2 and using tubing 21 for producing through well 3. At the same time the alternate liquid and gas injections are continued into the upper portion of the formation via upper tubing 20. In this way a considerable amount of additional crude oil recovery is achieved before high water cut (from the encroaching water of the L and G zones) dictates switching over to using tubing 21 of well 3 for steam injection and well 2 for producing as in the first embodiment above.

To recapitulate, the advantages of establishing (1) the non-perforated casing 22 to seal off the middle portion of the well 3 liner and (2) the jammed region 24 are that the following procedures and combinations thereof can be carried out with resulting substantial improvements in recovery of oil that is otherwise overridden by steam and left behind as oil banked around the bottom of well 3:

reverse the functions of wells 2 and 3, so that steam is injected at 3 and production is taken at 2;

after establishing the jammed region, do not stop the alternate liquid and gas injections but continue them so as to utilize the L and G zones as a moving front driving production ahead of it;

retain the functions of wells 2 and 3, so that steam is injected at 2 and production is taken at 3, optionally while continuing the alternate injection of liquid and gas through tubing 20.

Figure 3:
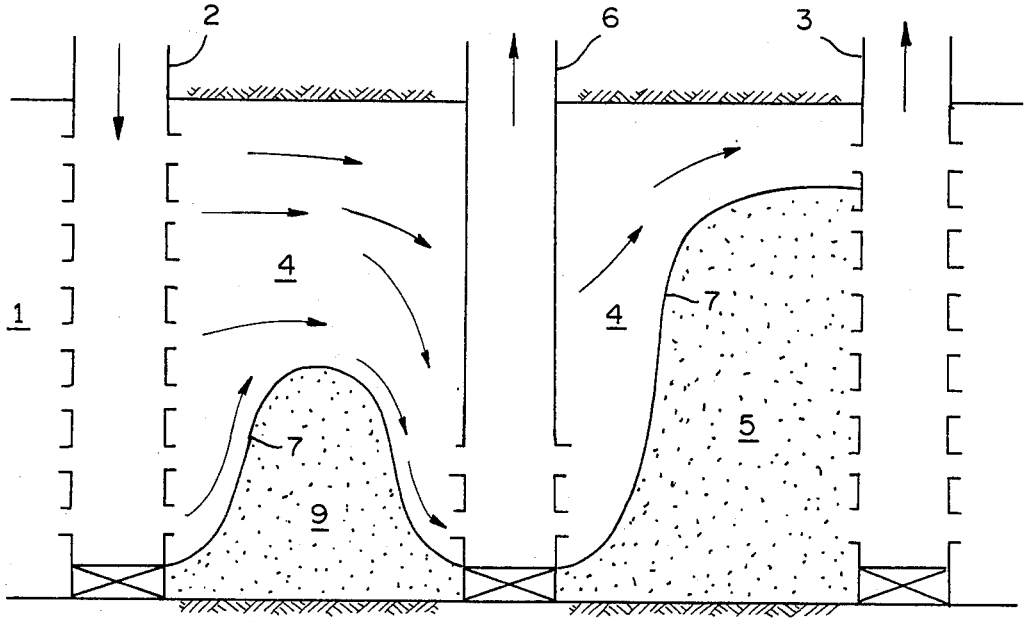
FIG. 3 PRIOR ART
FIG. 3 illustrates a vertical plane view of a subterranean formation penetrated by an injection well, a production well, and an infill well in a state-of-the-art steam drive oil recovery method such as is taught in the prior art, illustrating how the same steam override condition as in FIG. 1 occurs also when an infill well is used.

FIG. 3 illustrates the steam override condition which is found when an infill well 6 exists between the injection or center well 2 and the production or corner well 3 in a state-of-the-art steam drive operation. Infill well 6 has perforations only at the lower end in order to force the steam to sweep low in the formation surrounding well 6, and consequently unswept region 9 is reduced to a fairly low magnitude. Unswept region 5 surrounding well 3 however is unsatisfactorily large, just as in FIG. 1.

Figure 4:
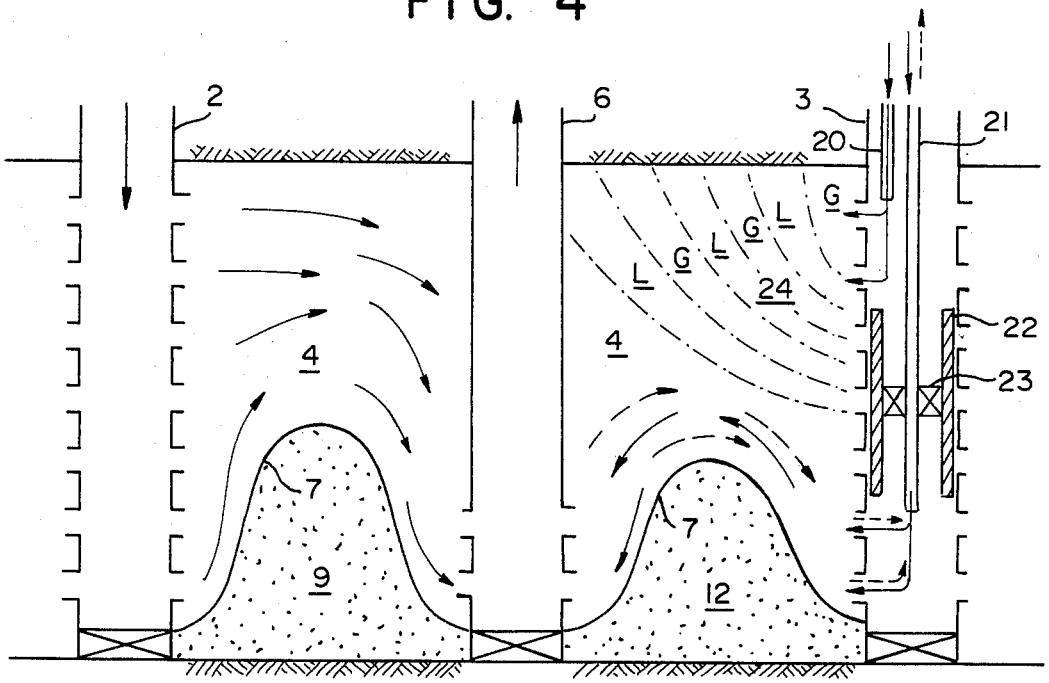
FIG. 4 illustrates the same view of the subterranean formation as FIG. 3 after the steps of this invention have been taken to close off all passages of fluid communication between the production well and the formation except those communicating with a top fraction less than half and a bottom fraction less than half of the formation and to block the override region in the upper portion of the formation around the production well. Again two embodiments are illustrated in FIG. 4, one with solid arrows representing reverse steam flooding using the injection and production wells as production and injection wells respectively, and one with dashed arrows representing forward steam flooding using the injection and production wells in their original intended way.

FIG. 4 illustrates the method of this invention for the case where an infill well 6 exists between the center well 2 and the corner well 3. Once again as with the two-well pattern of FIG. 2, two embodiments are illustrated, the first as indicated by solid arrows and the second by dashed arrows. For both embodiments corner well 3 is prepared in the same way as well 3 was in FIG. 2, i.e. with the non-perforated casing section 22 cemented inside liner 10 and with the region 24 of the formation surrounding the upper perforations of well 3 blocked so as to obstruct fluid flow within the formation.

In the first embodiment with an infill well (shown by solid arrows in FIG. 4) steam is injected in well 3 through tubing 21, either concurrently with the jamming step or following it, and sweeps outwardly through the lower perforations of well 3 into formation 1 toward infill well 6. The jammed region 24 prevents the steam from passing therethrough and forces it to pass low through the hitherto unswept portion of the formation as shown by FIG. 4. The hitherto unswept region shown as 5 in FIG. 3 is thereby reduced in size to the region shown as 12 in FIG. 4, and a significant portion of the hot oil that had been banked around the bottom of well 3 is produced from infill well 6. Thus vertical conformance has been improved.

In the second embodiment (as shown by the dashed arrows in FIG. 4) instead of injecting steam through tubing 21 and producing at well 6 the procedure is to continue injecting steam through well 2 and using tubing 21 for producing through well 3. At the same time the alternate liquid and gas injections are continued into the upper portion of the formation via upper tubing 20. In this way a considerable amount of additional crude oil recovery is achieved before high water cut (from the encroaching water of the L and G zones) dictates switching over to using tubing 21 of well 3 for steam injection and well 6 for producing as in the first embodiment above. In a useful modification of the second embodiment well 6 may be either used as an injection well or closed in with no fluid flow.

To recapitulate, the advantages of establishing (1) the non-perforated casing 22 to seal off the middle portion of the well 3 liner and (2) the jammed region 24 are that the following procedures and combinations thereof can be carried out with resulting substantial improvements in recovery of oil that is otherwise overridden by steam and left behind as oil banked around the bottom of well 3:

reverse the function of well 3, so that steam is injected at well 3 and production is taken at well 6;

after establishing the jammed region, do not stop the alternate liquid and gas injections but continue them so as to utilize the L and G zones as a moving front driving production ahead of it;

retain the function of well 3, so that steam is injected at well 2 and production is taken at wells 3 and 6, optionally while continuing the alternate injection of liquid and gas through tubing 20.

While particular embodiments of the invention have been described above in accordance with the applicable statutes this is not to be taken as in any way limiting the invention but merely as being descriptive thereof. All such embodiments are intended to be included within the scope of the invention which is to be limited only by the following claims.

I claim:

1. A method of recovering petroleum from a subterranean, petroleum-containing formation, which is penetrated by at least a first well, and a second well, said wells being spaced apart and having well perforations in fluid communication with a substantial portion of said formation, said formation being characterized by an overriding steam swept zone high in the formation, from which petroleum has been removed as the result of steam being injected at said first well, and production being taken at said second well, the formation being further characterized by an unswept, petroleum-containing zone underlying said overriding steam swept zone, said method comprising the steps of:

closing those well perforations which define passages of fluid communication between said second well and said formation, excepting those perforations which communicate with a top fraction of the formation encompassing less than half the well length, and those perforations in the bottom fraction of the well which encompass less than half of said well length, forming a multi-phase fluidic barrier about the upper portion of said second well, said barrier being capable of blocking or deflecting upward flow of a thermal, petroleum recovery fluid, and comprising alternately arranged layers of a liquid and a gaseous component, injecting a flow of said thermal petroleum recovery fluid into the lower end of said second well, whereby to enter the formation, and recovering said thermal oil recovery fluid including petroleum, from the formation by other of said wells.

2. In the method as defined in claim 1, wherein said multi-phase fluidic barrier comprises alternately arranged layers of an aqueous blocking agent and said gaseous component.

3. In the method as defined in claim 1, wherein said multi-phase fluidic barrier comprises alternately arranged layers of water and said gaseous component.

4. In the method as defined in claim 3, wherein the multi-phase fluidic barrier is comprised of alternate layers of water and flue gas.

5. In the method as defined in claim 1, wherein said multi-phase fluidic barrier is formed by sequentially injecting into the upper end of said second well, discrete amounts of water and said gaseous component.

6. In the method as defined in claim 1, wherein the gaseous component of said fluidic barrier is flue gas.

* * * * *